US008573565B1

(12) United States Patent
Lyndaker et al.

(10) Patent No.: US 8,573,565 B1
(45) Date of Patent: Nov. 5, 2013

(54) MULTIPURPOSE SEASONAL SAFETY SUPPORT FENCE

(75) Inventors: Bob Lyndaker, Beaver Falls, NY (US); Bob Chamberlain, Castorland, NY (US); Dave Moore, Castorland, NY (US); Mickey Lehman, Croghan, NY (US)

(73) Assignee: Grand Slam Safety, LLC, Beaver Falls, NY (US)

( * ) Notice: Subject to any disclaimer, the term of this patent is extended or adjusted under 35 U.S.C. 154(b) by 412 days.

(21) Appl. No.: 12/607,032

(22) Filed: Oct. 27, 2009

(51) Int. Cl.
*A01G 17/06* (2006.01)

(52) U.S. Cl.
USPC ..... 256/23; 256/24; 256/45

(58) Field of Classification Search
USPC ..... 256/23–25, 28–31, 33, 45, 46, 65.14, 256/19, DIG. 5
See application file for complete search history.

(56) References Cited

U.S. PATENT DOCUMENTS

| | | | | | |
|---|---|---|---|---|---|
| 1,566,945 | A * | 12/1925 | Winkley | 473/173 |
| 2,785,897 | A * | 3/1957 | Lennon | 256/23 |
| 4,174,096 | A * | 11/1979 | Campbell | 256/24 |
| 4,284,277 | A | 8/1981 | Leonard et al. | |
| 4,605,204 | A | 8/1986 | Schmanski et al. | |
| 4,765,596 | A * | 8/1988 | Fontana | 256/65.14 |
| 4,815,713 | A * | 3/1989 | Schmanski | 256/19 |
| 4,969,651 | A * | 11/1990 | Comartin | 273/410 |
| 5,029,819 | A | 7/1991 | Kane | |
| 5,165,663 | A * | 11/1992 | Wells | 256/19 |
| 5,180,143 | A | 1/1993 | Brower | |
| 5,215,310 | A * | 6/1993 | Allbright | 473/493 |
| 5,218,900 | A * | 6/1993 | Elliott | 100/343 |
| 5,394,927 | A * | 3/1995 | Huebner | 256/45 |
| 5,407,178 | A * | 4/1995 | Long | 256/45 |
| 6,176,471 | B1 | 1/2001 | Naegele et al. | |
| 6,676,532 | B1 * | 1/2004 | Boulton et al. | 473/197 |
| 6,851,661 | B1 | 2/2005 | Penning | |
| 7,150,243 | B1 * | 12/2006 | Greene | 119/422 |
| 7,270,608 | B2 * | 9/2007 | Cho | 473/197 |
| 7,455,603 | B2 * | 11/2008 | Bouffard et al. | 473/492 |
| 8,328,695 | B2 * | 12/2012 | Ronan et al. | 482/29 |
| 2002/0098920 | A1 * | 7/2002 | Bruyer et al. | 473/421 |
| 2005/0109998 | A1 * | 5/2005 | Sadinsky | 256/25 |
| 2005/0285092 | A1 * | 12/2005 | Pesta | 256/65.14 |
| 2006/0086567 | A1 * | 4/2006 | Deuer | 182/8 |
| 2008/0283809 | A1 * | 11/2008 | Hoffman, Jr. | 256/23 |
| 2010/0187491 | A1 * | 7/2010 | Anson et al. | 256/68 |

* cited by examiner

*Primary Examiner* — Victor Macarthur
*Assistant Examiner* — Matthew R. McMahon

(57) ABSTRACT

A fence that bounds the outfield of a game played with bat and ball comprises a plurality of mesh panels suspended from a plurality of support posts, with foul posts at either end. The fence can be readily assembled and disassembled. The support posts' anchors can be covered when the fence is disassembled, so that the field is usable for other sports. The function of the fence is twofold: (1) to minimize injury to a player who runs into the fence and (2) to confine such a player within the field of play should the player impact the fence.

20 Claims, 13 Drawing Sheets

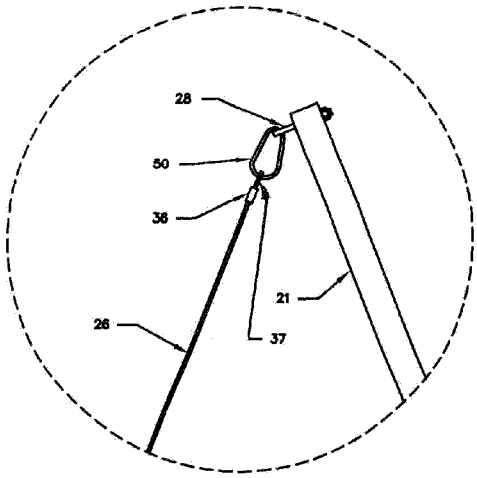
FIGURE 6 (DETAIL 1)
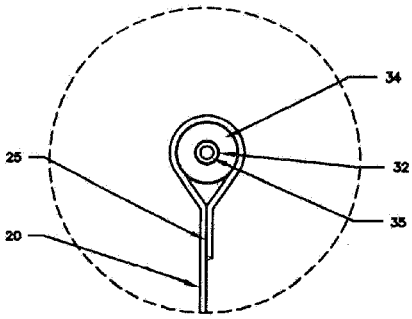
DETAIL 2
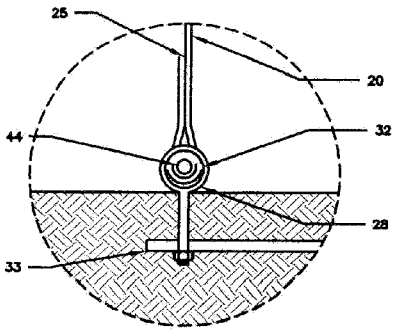
DETAIL 3
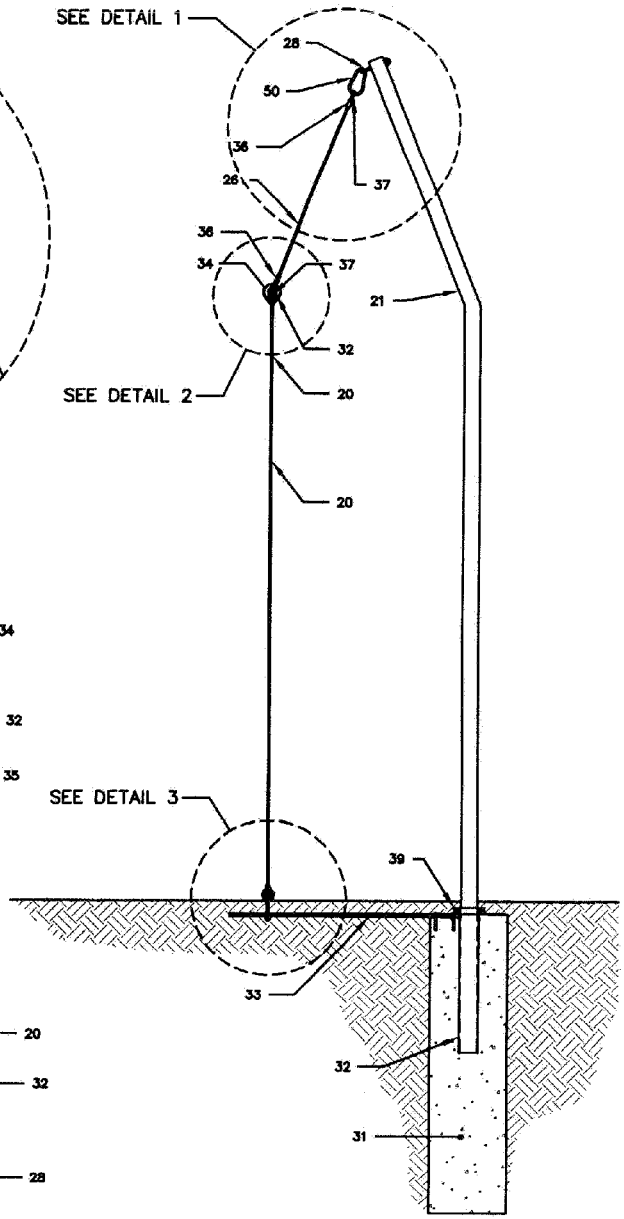
FIGURE 3

MULTIPURPOSE SEASONAL SAFETY SUPPORT FENCE

BACKGROUND OF THE INVENTION

This invention pertains to a fence useful for a sports field where an athlete can collide with the fence. More specifically, this invention offers a fence that provides containment to a player who runs into the fence. In the present invention, the player comes into contact with a mesh that repels him back onto the field of play with minimum risk of injury. After repelling a player, the safety fence returns to its prior position, thereby maintaining play without disruption.

In many sports, fence-like structures define the perimeter of play. For example, a baseball diamond includes an outfield bounded by a fence (or wall). If a batter hits a baseball beyond the fence, he scores a home run. Accordingly, a baseball player in the outfield may jump up to catch a ball likely to go over the fence.

In these circumstances, the player may collide with the fence, because the player runs toward the fence when he realizes that the ball is sufficiently high for a home run. Injury to the player is likely where the fence is made of rigid materials. The player must therefore balance instantaneously the likelihood of his catching the ball versus the risk of injury if he collides with the fence. Misjudgment leads to either unnecessary reluctance of the player to field a ball or to injury. These problems are more serious for younger, inexperienced players, such as Little League, junior high school, and high school players than for collegiate and professional players.

Attempts have been made to use plastic mesh as fence material in combination with thermoplastic tubes as fence poles. The weight of the fence, however, makes these materials unsuitable. In addition to allowing the fence material to sag, they lack the resilience to restore the fence to its original configuration after it deflects from impact.

In most baseball and softball games played by school teams, the players do not experience the same game as collegiate and professional players do. To hit a home run, the school player has to hit the ball so far that s/he can run all the bases before the ball can be fielded. This situation arises, not from financial limitations (costs of erecting and maintaining fences) but from safety considerations: preventing injury to players. Moving the outfield fence closer to home plate and thus bringing it into play (thereby improving "playability") is simply too dangerous if the fence is a solid structure, such as plywood/post or chain-link.

Examples from the prior art address safety from both aspects, "playability" and "continuation of play," without achieving a satisfactory solution.

U.S. Pat. No. 4,284,277 (Aug. 18, 1981) to Leonard et al. for a "Kick Ball Game and Apparatus Kit" discloses a "fabric type mesh net to contain the ball within the playing surface" that "provide[s] a surface off of which the ball may be ricocheted" during the playing of a game of kick ball. This fence cannot contain the impact at full force of a player running at full speed. The "mesh net" boundary fence cannot be adapted to protect players on a baseball or softball field, as the mesh is anchored and is secured directly to the solid support posts. Thus the fence of Leonard et al. presents a significant risk of injury to a player who runs into it.

U.S. Pat. No. 4,605,204 (Aug. 12, 1986) to Schmanski & Landis for a "collapsible recreational fence" discloses a "flexible, resilient, plastic fence mesh attached to fiber reinforced plastic support posts which . . . deflect under the weight of impact." Though this design is not a solid structure and therefore poses no threat of impact injury, it cannot prevent the player from literally toppling over the fence as it collapses. The player would therefore leave the field. Because the fence of Schmanski & Landis is designed to "immediately restore to an original upright condition", it cannot satisfy the criterion of "continuation of play", as can the present invention, because the player would have to climb over the fence to get back into the field of play. Moreover, the height of the fence of Schmanski & Landis makes it possible for a player to jump high enough, while reaching for a ball, to go over the fence backwards, thereby risking a head injury. The pull of the player's legs against the fence may not be sufficient to cause the fence to collapse completely yet be strong enough to cause players to topple onto their heads.

U.S. Pat. No. 5,029,819 (Jul. 9, 1991) to Kane for "Handling and Supporting Flexible Material of a Fence" also discloses mesh material directly attached to rigid support posts, thereby creating a threat of injury if applied to an outfield fence for a baseball or softball field.

U.S. Pat. No. 5,180,143 (Jan. 19, 1993) to Brower discloses a "portable sport boundary fence." Though not a solid structure, the fence of Brower falls short of keeping the player from injury and ensuring continuation of play. Brower's fence posts "either bend or break to avoid injury to the player." A broken post is itself a risk to the player who falls on it. Brower's fence is designed to fall away, so a player can fall through the fence, thus ending up outside the field of play. Like the fence of Schmanski & Landis, the height of Brower's fence also poses a hazard if players end up on their heads.

U.S. Pat. No. 6,176,471 (Jan. 23, 2001) to Naegele and Loven for a "Fabric Fence System" also discloses mesh affixed directly to a rigid support structure that includes both vertical and cross members, thereby creating a threat of injury to players.

U.S. Pat. No. 6,851,661 (Feb. 8, 2005) to Penning for a "multi-purpose portable lay-down fence" is also not a solid structure. Penning discloses a framed structure of insufficient height and flexibility. It allows players jumping up for a ball to go over the fence backwards, ending up on their heads outside the field of play. Thus Penning's fence cannot provide both mitigation of the risk of injury and continuation of play.

The verticality of a fall by the player increases the chance of injury because a structure framed or supported by posts offers increased resistance along its vertical plane. The prior art's structures have their maximum flexibility in a horizontal direction. This flexibility diminishes significantly as the vector force of impact increases vertically. Thus a player near the fence who jumps vertically to catch a ball may, because of the fence's short height, fall vertically, thereby challenging the fence's vertical strength. Posts or other framing may cause serious injury to the player by offering significant resistance to a downward force exerted by a falling player.

In addition, none of the structures of the prior art as assembled respond to the effects of high winds.

OBJECTS AND SUMMARY OF THE INVENTION

It is an object of the present invention to provide a fence that both deflects under the impact of a player and restores to its full integrity after such impact.

It is a further object of the present invention to provide a fence that protects from injury a player running into the fence.

A still further object of the present invention is to provide a method of constructing a fence for areas of possible player impact where deflection of the fence prevents injury to the player.

Yet another object of the present invention is to provide a fence that keeps the player on the field of play, after a collision with the fence, thereby allowing for the continuation of play.

The present invention comprises a substantial length of flexible, resilient mesh suspended by a cable system, which is in turn suspended from steel posts mounted behind the mesh. The suspended mesh and cable system of the present invention withstands buckling loads, thereby allowing nondestructive deflection of the mesh and cable system upon impact by a moving player, with subsequent immediate restoration of the mesh to its original position. The mesh and cable system is suspended from steel posts to form a unified fence structure maintained in vertical orientation by the supports posts. This unified fence structure is oriented horizontally in a continuous arc from foul pole to foul pole.

The multipurpose seasonal sport safety fence of the present invention is not a permanent structure. Therefore the field on which it is erected is available for other activities during other seasons. Since it's not a solid structure, it provides a gentle repelling effect on a player who jumps up against it or runs into it. The sport safety fence of the present invention, constructed of vinyl-coated mesh, has superior durability and tensile strength. The steel posts of the sport safety fence of the present invention are anchored in the ground, thereby allowing the fence to maintain its integrity, both during play when impacted by a player and when high winds are present. The fence is entirely within the field of play, thereby allowing the players to experience the game of baseball or softball it is played at the professional level.

In conclusion, the multipurpose seasonal sport safety fence of the present invention provides a gentle repelling effect for players as they jump up against it or run into it. Even when running at full speed into the fence, a player experiences only cradling as the fence brings the player to a halt and recoils the player back into the playing field. The multipurpose seasonal sport safety fence of the present invention completes the game of baseball and softball for elementary, high school, and college players by providing an outfield fence that bounds the field realistically while minimizing the possibility of impact injury.

Other objects and features of the present invention will be apparent to those skilled in the art based upon the following brief description of the invention:

BRIEF DESCRIPTION OF DRAWINGS

FIG. 3 shows the concrete anchor, conduit fastener, steel support post, eyebolt, snap link, diagonal connector cable, top tie cable, mesh, bottom tie cable, bottom eye bolt, and ground anchor channel iron.

FIG. 6 shows detailed views of the steel support post's top, eyebolt, snap link, and diagonal connector cable assembly.

DETAILED DESCRIPTION OF THE PREFERRED EMBODIMENT

Figure 1:
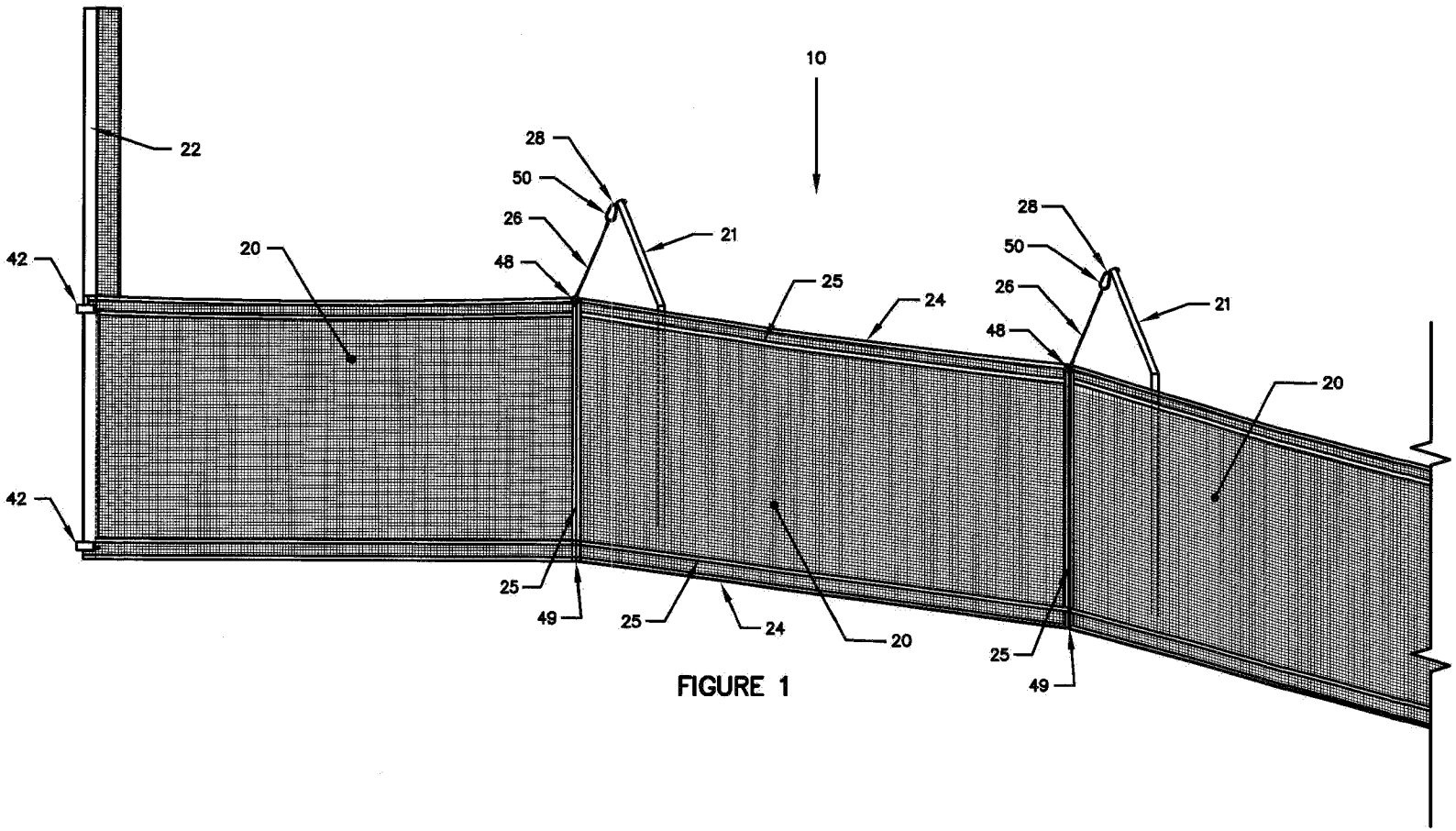
FIG. 1 shows a frontal view of the present invention as installed, beginning at the left foul pole.

Referring to FIG. 1, a multipurpose seasonal sport safety fence 10 can be an outfield fence for baseball and softball fields of all sizes. The fence structure comprises a plurality of mesh panels 20 of a height determined by the size and age of the players and a length chosen so that the number of panels bounds the field from a left-hand foul pole 22 to a right-hand foul pole 22 (not shown). Panels 20 are suspended by a tie cable/PVC assembly 24 secured to a diagonal connector cable 26 and a snap link 50. Snap link 50 is attached to an eyebolt 28 mounted to the top of a steel support post 21 mounted behind each mesh panel 20. A plurality of steel support posts 21 are laid out in an arc from left-hand foul pole 22 to right-hand foul pole 22 (not shown). The bottom of fence 10 is secured by a bottom anchor and bottom tie cable assembly 49. Seams of mesh panels 20 are secured by hook and loop rope assemblies 25 made up of a wide hook rope 29, a narrow hook rope 29A, a wide loop rope 30, and a narrow loop rope 30A (see FIG. 2).

Figure 2:
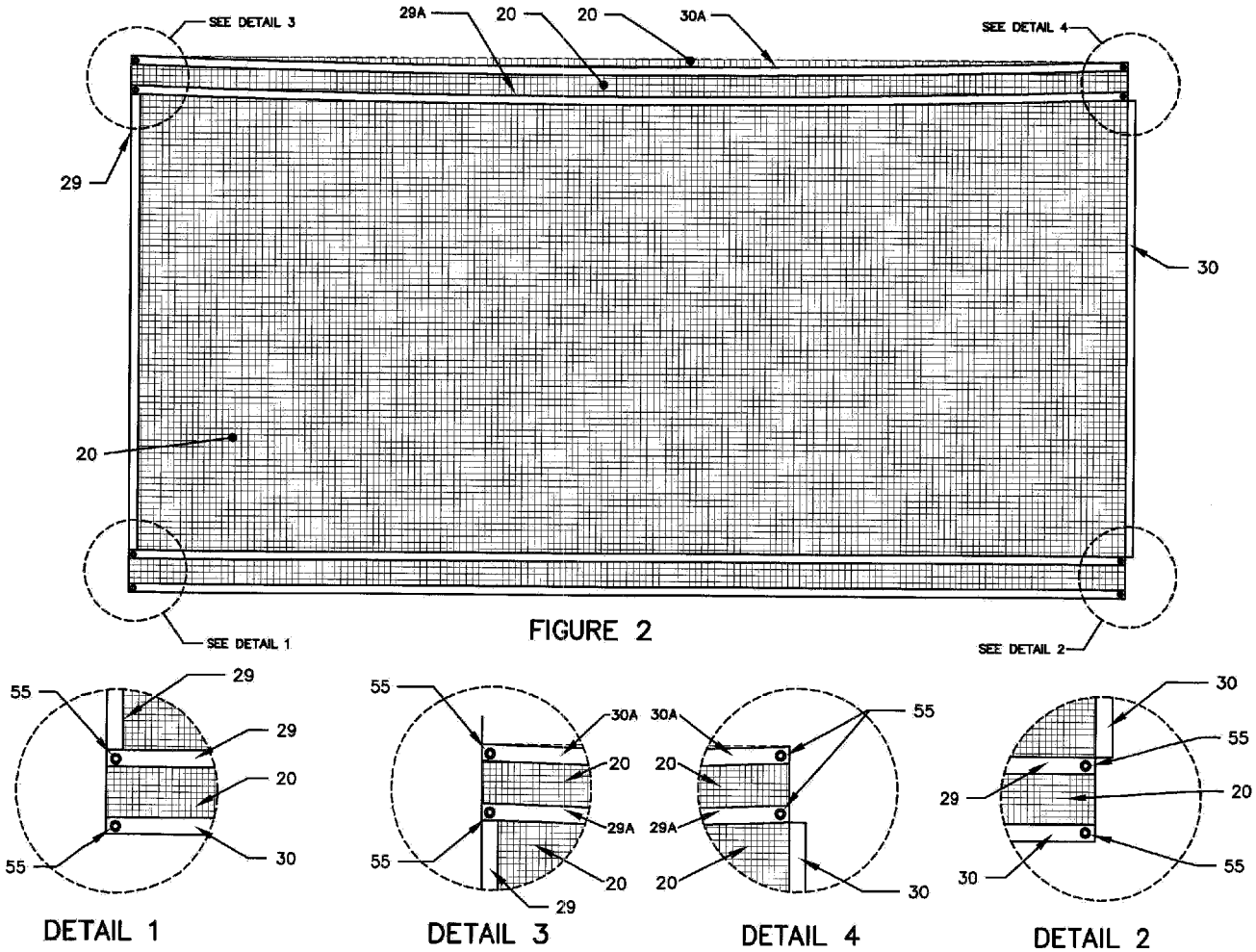
FIG. 2 shows a rear view of a single mesh panel prior to installation, illustrating the hook-and-loop rope and the location of reinforcement fasteners.

Referring to FIG. 2, a rear view of mesh panel 20 prior to installation shows the seams of mesh panels 20 held together by wide hook and loop ropes 29 and 30 and narrow hook and loop ropes 29A and 30A so that a damaged panel can be removed and replaced while fence 10 is assembled. Wide loop rope 30 is sewn to the bottom back edge of each mesh panel 20. Wide hook rope 29 is sewn at a distance above wide loop rope 30 to be everywhere equidistant from wide loop rope 30. On installation the bottom seam of each mesh panel 20 is formed by folding wide hook rope 29 over wide loop rope 30. Similarly, the top seam of each mesh panel 20 is formed by folding narrow hook rope 29A over narrow loop rope 30A. Narrow hook rope 29A and narrow loop rope 30A are sewn in a slightly downwardly arc, with each reaching the bottom apex of the arc in the horizontal center of each mesh panel 20. This arc is necessary to insure that, when a top tie cable 35 (see FIG. 3) is tightened to the desired tension, each mesh panel 20 has a uniform vertical tension. Reinforcement fasteners 55 at the ends of hook and loop ropes 29, 29A, 30, and 30A provide additional support for the connections at the ends of each hook and loop rope assembly 25. Narrow hook rope 29A and narrow loop rope 30A form the top seam of each mesh panel 20 so that, when high winds can damage fence 10, the hook and loop rope assembly 25 of narrow hook rope 29A and narrow loop rope 30A separates first, allowing mesh panels 20 to lay down flat during high winds, thereby avoiding damage to steel support posts 21 and tie cable/PVC assemblies 24. Wide hook rope 29 is vertically sewn to the left end of the back side of mesh panel 20. Wide loop rope 30 is vertically sewn on the right end of the front side of mesh panel 20. Thus, when fence 10 is assembled, wide hook rope 29 and wide loop rope 30 connect mesh panels 20 together horizontally. Mesh panels 20 have maximum tensile strength in both horizontal and vertical directions, thereby allowing mesh panels 20 to reach maximum tension during final assembly of fence 10. Diagonal-weave mesh may be appropriate when less tension in mesh panels 20 is appropriate.

Referring to FIG. 3, a support post 21 is inserted into a PVC conduit 32 and sunk to an effective depth in a concrete base 31. The part of support post 21 that is at the height of mesh panel 20 is bent to an angle that insures, when a player runs into fence 10, the player makes contact with the mesh only. A conduit fastener 39 adjusts the height of support post 21. An eyebolt 28, snap link 50, a connector cable sleeve 36, and a steel thimble 37 attach one end of diagonal connector cable 26 to support post 21. The other end of diagonal connector cable 26 is connected to mesh panel 20 by a top tie cable 35 encased in a PVC conduit 32. PVC conduit 32 is in turn encased in padding 34. When top tie cable 35 is winched by winch 42 (see FIG. 1) to optimal tension, the top of fence 10 reaches its optimal position with each mesh panel 20 at full vertical height and stretched to full horizontal width between successive steel support posts 21. PVC conduit 32 and padding 34 soften the top edge of fence 10 and provide a larger surface area of contact for mesh panel 20's seam, thus reducing wear that would result if mesh panel 20 were in direct contact with the narrower top tie cable 35. Top tie cable 35, encased in PVC conduit tubing 32 and padding 34, runs inside the top seam of mesh panel 20. Mesh panel 20's seams are secured by hook and loop rope assembly 25. The bottom of mesh panel 20 is secured to the ground with a bottom tie cable 44 (see FIG. 6, Detail 3), encased in PVC conduit 32, that runs through the bottom seam of mesh 20, with the seam secured by hook and loop rope assembly 25. Bottom tie cable 44 runs through eyebolt 28, which is secured to a bottom anchor channel iron 33.

Figure 4:
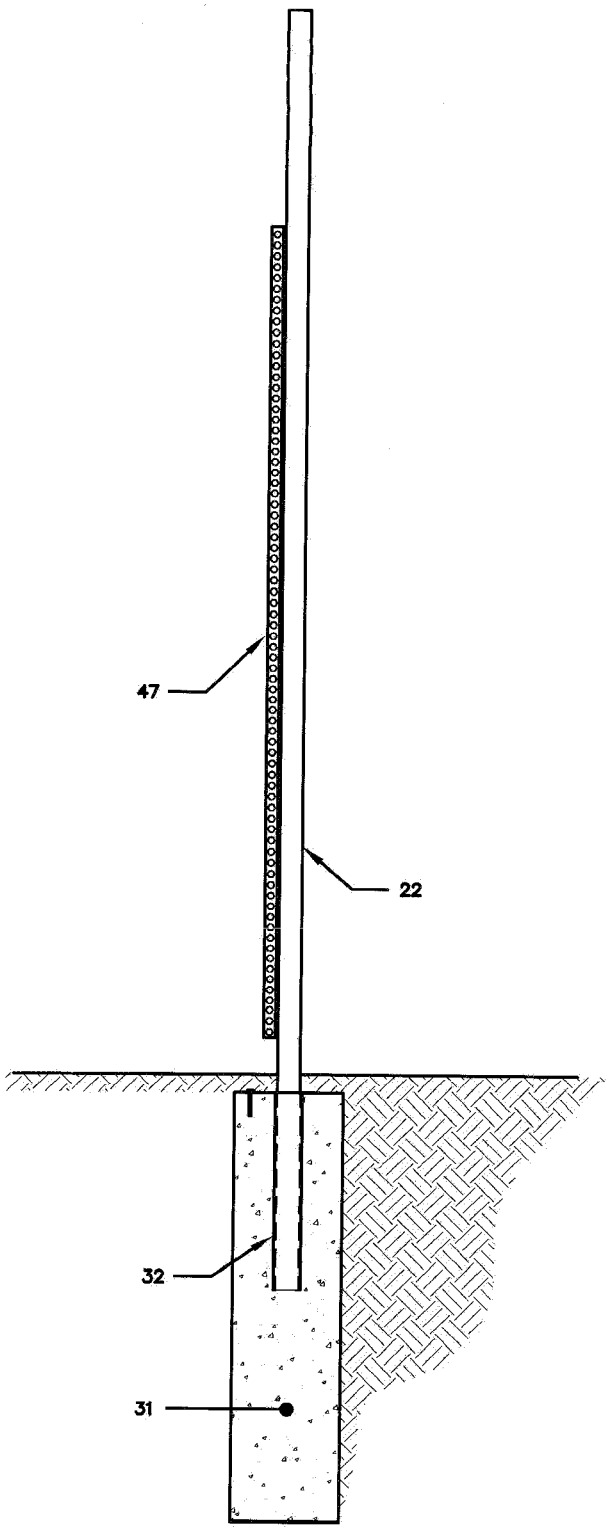
FIG. 4 shows the foul pole assembly.

Referring to FIG. 4, both left- and right-hand foul poles 22 are inserted into PVC conduit 32 sunk into concrete base 31. Each foul pole 22 has welded to it a channel iron 47 to which are fastened eyebolts 28 (not shown). Top tie cable 35 (not shown), bottom tie cable 44 (not shown), and winches 42 (not shown) are anchored by eyebolts 28.

Figure 5:
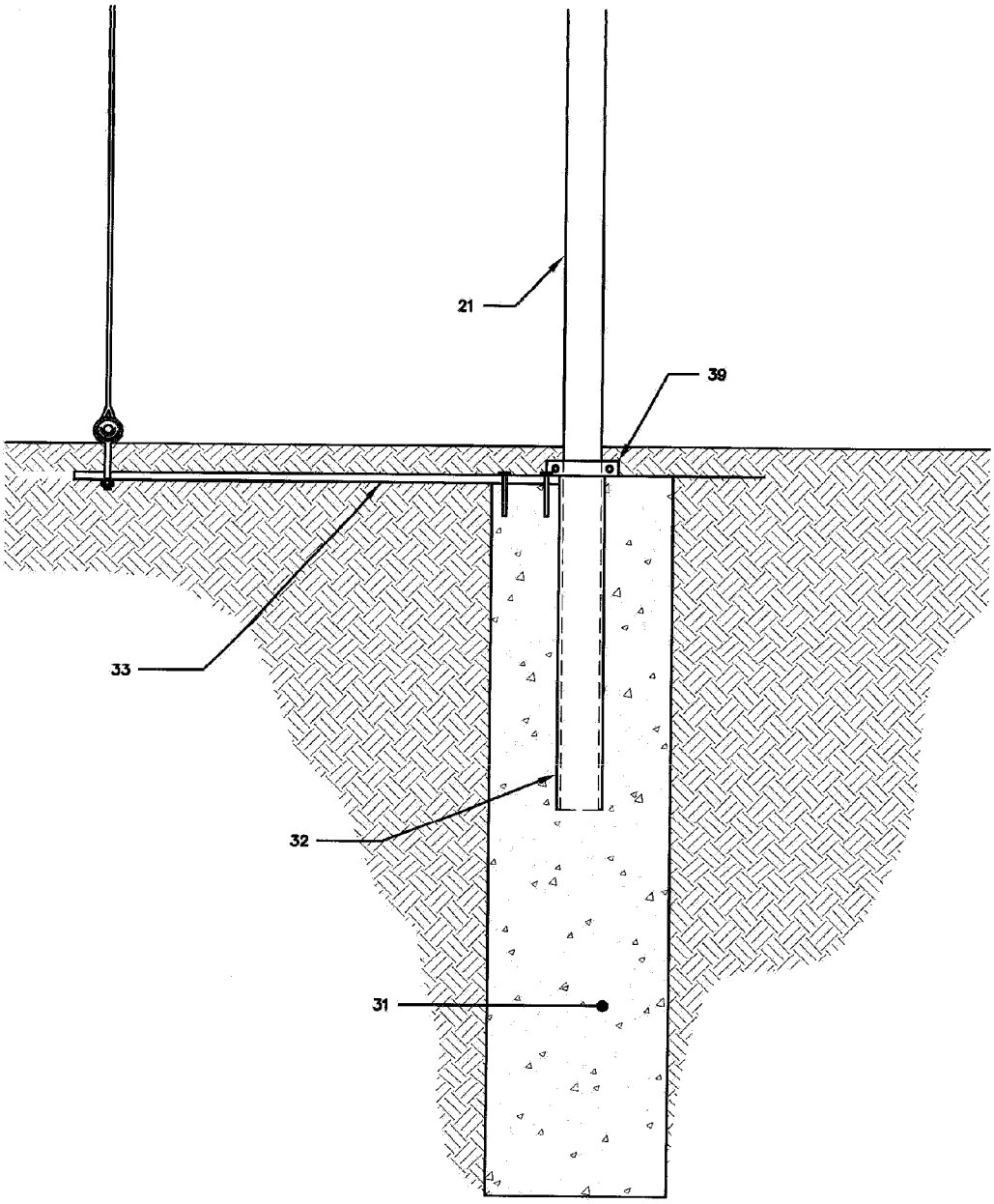
FIG. 5 shows a detailed view of the base of the steel support post.

Referring to FIG. 5, each support post 21 is inserted into PVC conduit sleeve 32 and sunk into concrete base 31. Conduit fastener 39 is attached to the base of the steel support post 21 to allow for adjustment of the height of support post 21. Bottom anchor channel iron 33 is mounted to the top of concrete base 31.

Referring to FIG. 6, each support post 21 has eyebolt 28 installed at the top end. Attached to eyebolt 28 is snap link 50, which in turn attaches to diagonal connector cable 26, which has inserted on each end steel thimble 37 secured by a connector cable sleeve 36.

Figure 7:
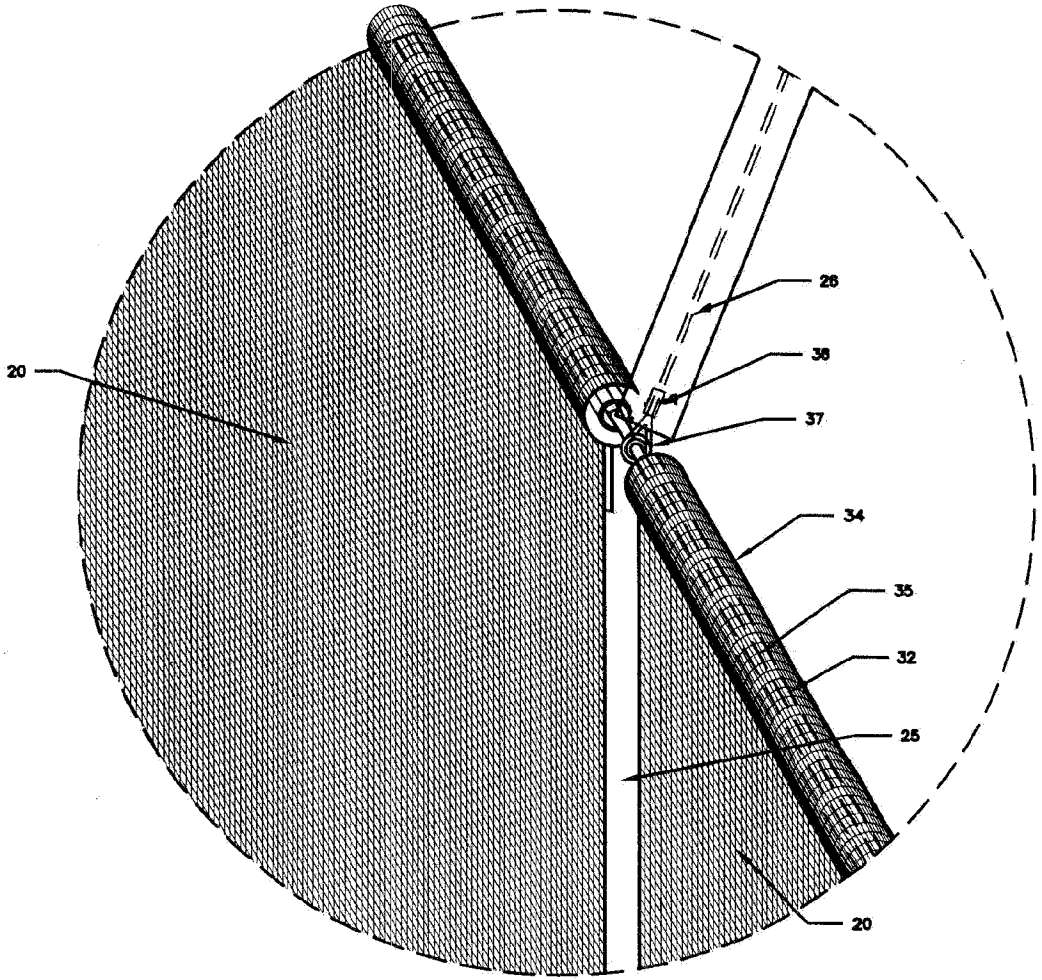
FIG. 7 shows the detail of the diagonal connector cable's attachment to the top of the fence.

Referring to FIG. 7, the end of diagonal connector cable 26 is looped with a thimble 37 and secured with connector cable sleeve 36. Top tie cable 35 runs horizontally along the top of fence 10 and through the bottom eye of diagonal connector cable 26. Top tie cable 35 is encased in tubular PVC conduit 32, which in turn is encased in padding 34, and runs through the top seam of mesh panel 20. Adjoining mesh panels 20 are held together side by side with vertically sewn wide hook and loop ropes 29 and 30 (see FIG. 2).

Figure 8:
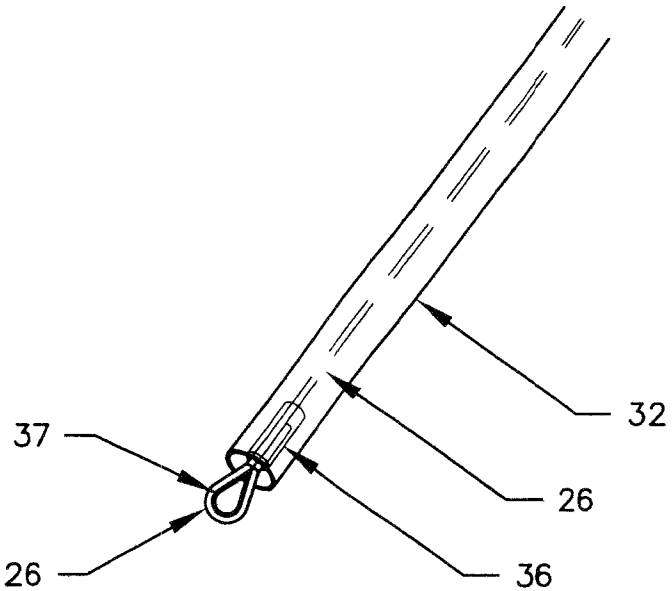
FIG. 8 shows a detailed view of the bottom end of the diagonal top connector cable assembly when fully assembled with PVC conduit.

Referring to FIG. 8, the lower section of diagonal connector cable 26 is encased in PVC conduit 32 prior to top tie cable 35 (not shown) being threaded through thimble 37. Connector cable sleeve 36 is used to secure the loop formed at the bottom end of diagonal connector cable 26.

Figure 9:
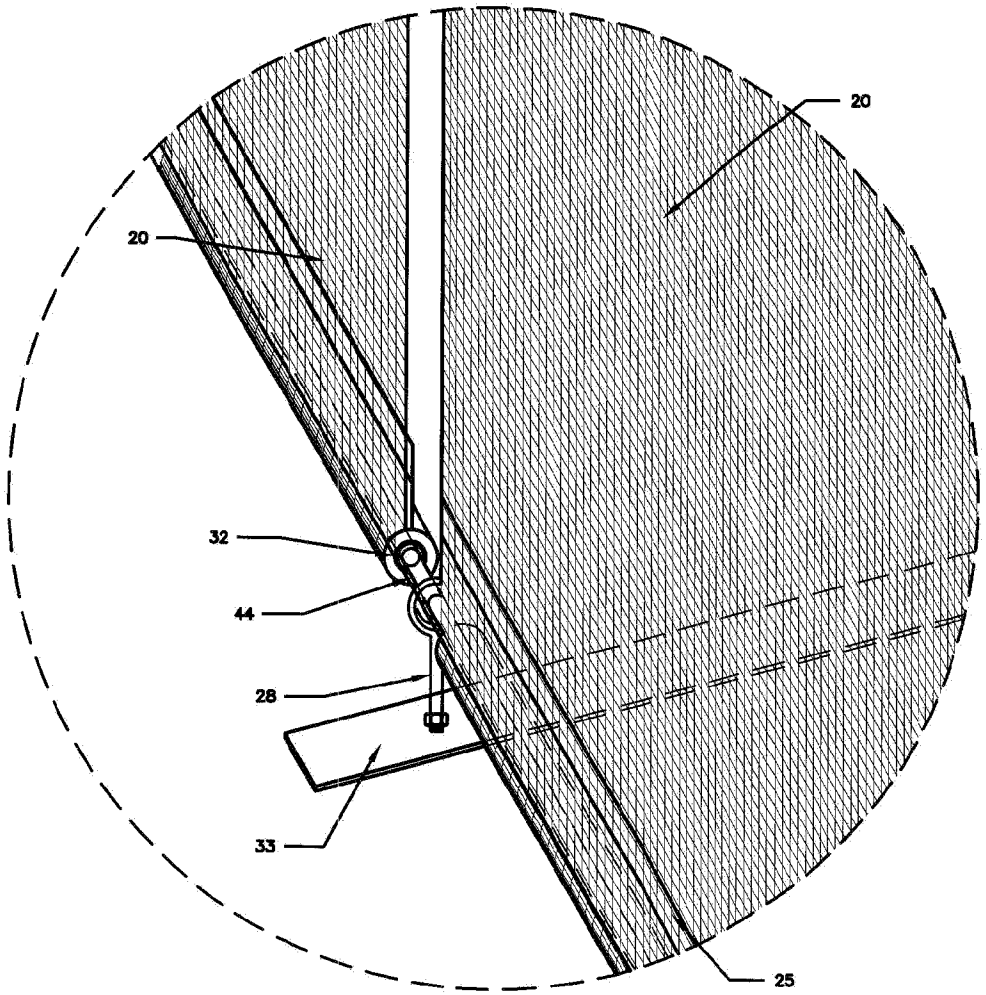
FIG. 9 shows a detailed view of the fence's bottom anchor assembly.

Referring to FIG. 9, bottom tie cable 44 is encased in PVC conduit 32, which runs through the bottom seam of each mesh panel 20. Bottom tie cable 44 is secured to the ground by eyebolt 28 bolted to bottom anchor channel iron 33.

Figure 10:
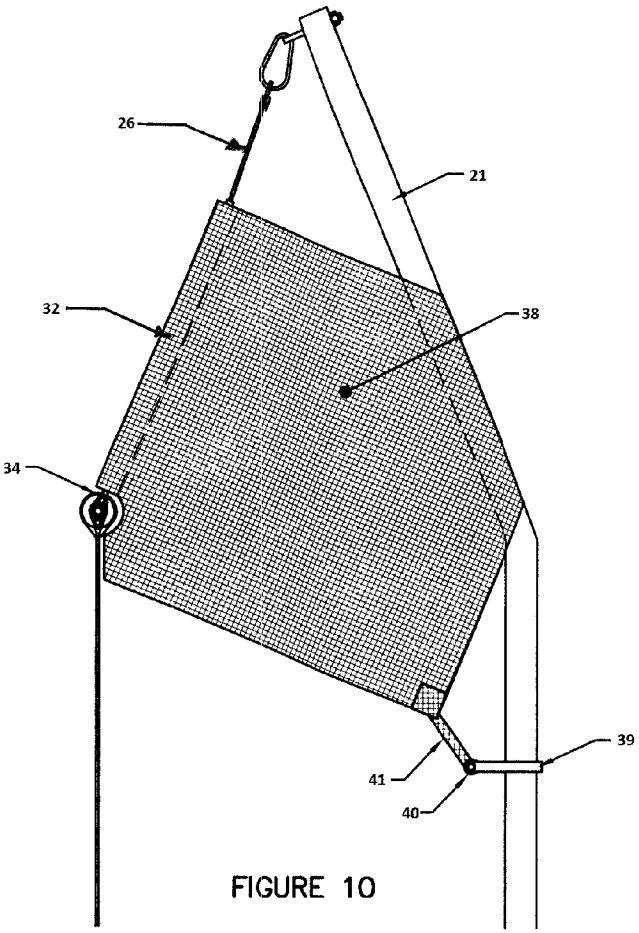
FIG. 10 shows a view of the fence top with the mesh skirt attached upon final assembly.

Referring to FIG. 10, the final phase of installing fence 10 requires a mesh skirt 38. Mesh skirt 38 slides over support post 21 and PVC conduit 32. Mesh skirt 38 is held down by grommets 40 installed in nylon straps 41 connected to the tension bolt of conduit fastener 39 mounted on support post 21. Mesh skirt 38 ensures that the arms of a player jumping up to catch a ball going over the fence cannot be caught under diagonal connector cable 26.

Figure 11:
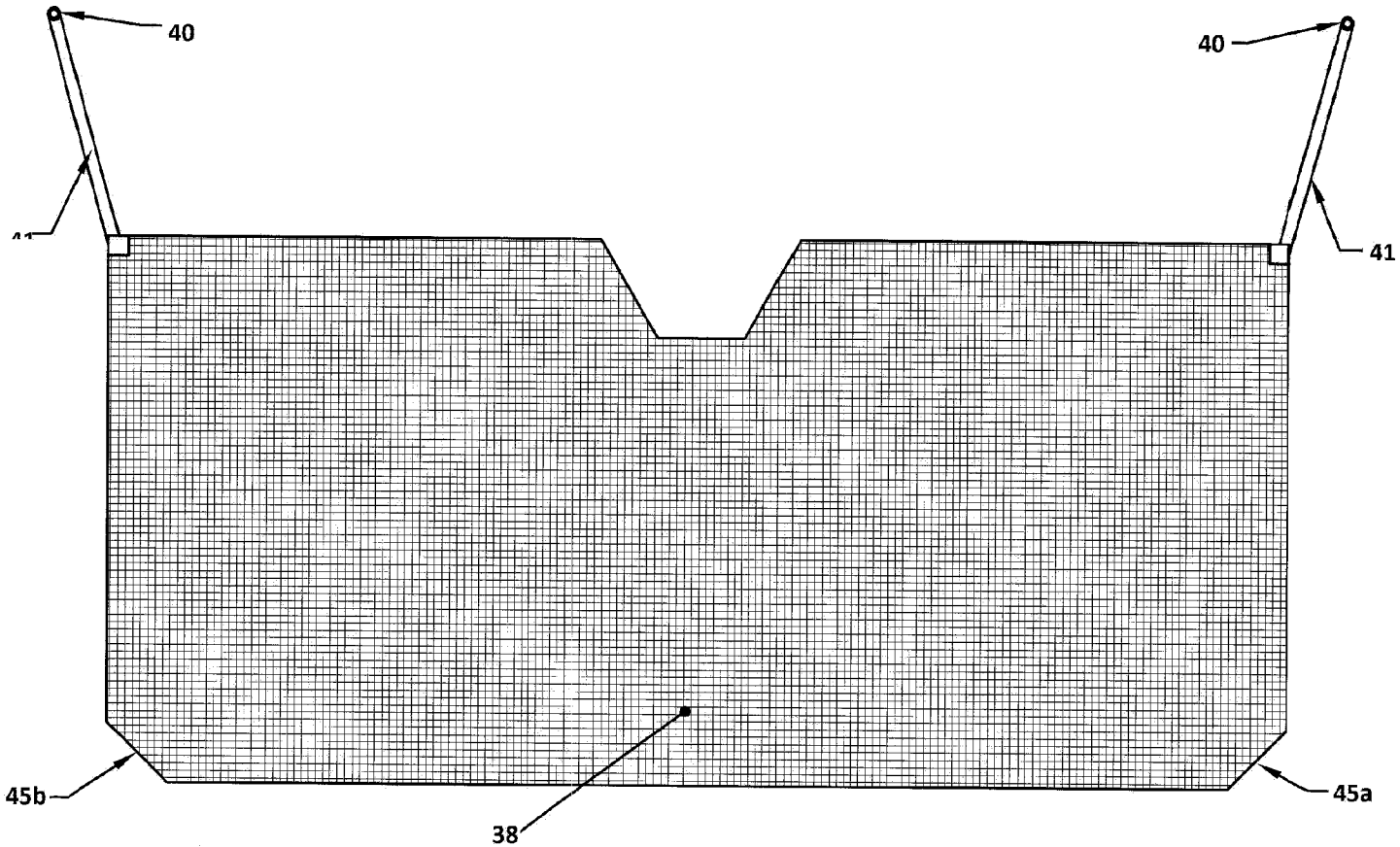
FIG. 11 shows the design of the mesh skirt.

Referring to FIG. 11, mesh skirt 38, cut to the shape shown, is sewn together at angled sides 45*a* and 45*b*. Mesh skirt 38 has a pair of nylon straps 41 sewn to each of its corners opposite angled sides 45*a* and 45*b*. Each nylon strap 41 terminates in grommet 40.

Figure 12:
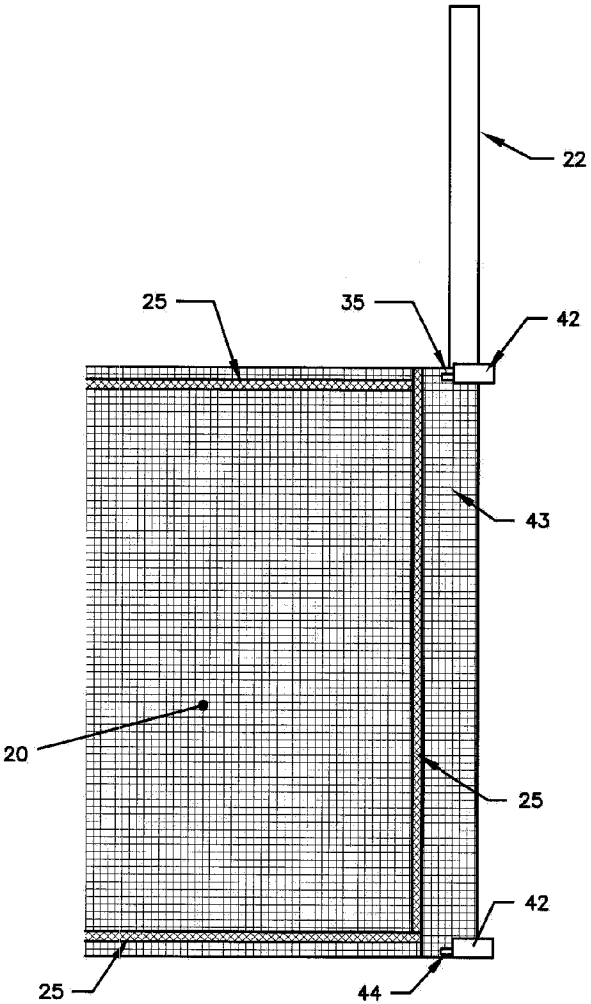
FIG. 12 shows a mesh panel at an end of the fence attached to a foul pole by a mesh pole jacket.

Referring to FIG. 12, winches 42 are installed on both top and bottom of one foul pole 22 and on the top only of the other. Both top tie cable 35 and bottom tie cable 44 are tightened by winches 42 during final installation of fence 10. Top tie cable 35 must have sufficient tension to pull the top of the assembled fence 10 to the maximum height allowed by mesh panels 20 and the maximum distance between each pair of support posts 21 (not shown) to insure resilience of each mesh panel 20. Bottom tie cable 44 is also winched to maintain the bottom of fence 10 close to the ground to ensure balls do not pass under fence 10. Winches 42 are required at both ends of top tie cable 35, one on each of foul pole 22, for optimal tightening of top tie cable 35. Only one winch 42 is required for optimal tightening of bottom tie cable 44. Each foul pole 22 has a mesh foul pole jacket 43 installed around it. Mesh panel 20 is attached to mesh foul pole jacket 43 by hook and loop assembly 25. In the final assembly of fence 10, commercially available standard pole/post padding is installed around each foul pole 22 (not shown). Bottom tie cable 44 is attached to one foul pole 22 with eye bolt 28 (not shown) and to the other foul pole 22 by use of winch 42.

Figure 13:
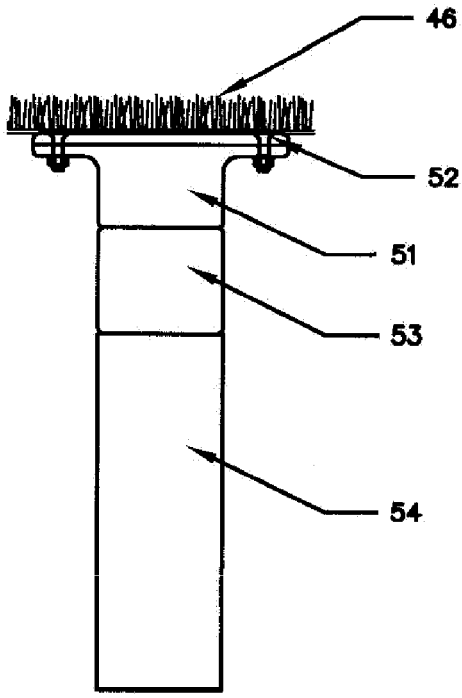
FIG. 13 shows a detailed view of the synthetic turf insert assembly.

Referring to FIG. 13, synthetic turf insert 46 is glued to a rubber base 52 secured to a metal flange 51. A PVC extension 54 is secured to metal flange 51 by a PVC adapter 53.

Figure 14:
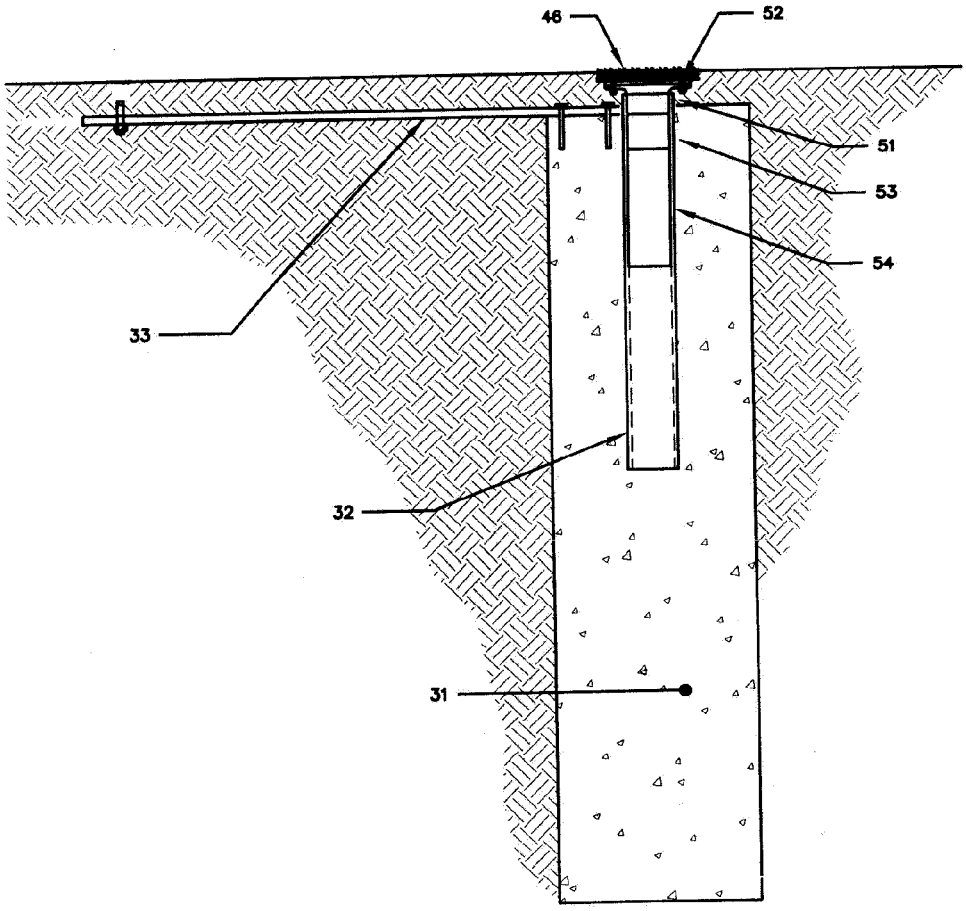
FIG. 14 shows the synthetic turf insert installed.

Referring to FIG. 14, when fence 10 is disassembled, PVC extension 54 is inserted into PVC conduit 32 sunk into concrete base 31. The top surface of concrete base 31 is slightly below ground level so concrete base 31 can be covered with a synthetic turf insert 46 when fence 10 is not assembled.

REFERENCE NUMBERS

10—Fence
20—Mesh Panel
21—Support Posts
22—Foul Pole
24—Tie Cable/PVC Assembly
25—Hook and Loop Rope Assembly
26—Diagonal Connector Cable
28—Eye Bolt
29—Wide Hook Rope
29A—Narrow Hook Rope
30—Wide Loop Rope
30A—Narrow Loop Rope
31—concrete base
32—PVC conduit
33—Bottom Anchor Channel Iron
34—Padding
35—Top Tie Cable
36—Connector Cable Sleeve
37—Thimble
38—Mesh Skirt
39—Conduit Fastener
40—Grommet
41—Nylon Strap
42—Winch
43—Mesh Foul Pole Jacket

44—Bottom Tie Cable
45*a*—Angled side
45*b*—Angled side
46—Synthetic Turf Insert
47—Channel Iron
48—Diagonal Connector Cable and Top Tie Cable Assembly
49—Bottom Anchor and Bottom Tie Cable Assembly
50—Snap Link
51—Metal Flange
52—Rubber Base
53—PVC Adapter
54—PVC Extension
55—Reinforcement Fasteners

What is claimed is:

1. A fence that confines a softball or baseball outfield, said fence comprising:

a continuous plurality of flexible, resilient mesh panels joined together in an arc, said plurality of mesh panels being bounded by a pair of foul poles marking the horizontal playing portion of said softball or baseball outfield;

a plurality of fixed support posts supported from beneath a ground surface in an arc that is offset from the arc defined by the mesh panels and is outside the confines of said outfield, said outfield being defined by the mesh panels, and each fixed support post being angled inwards toward the confines of the outfield;

said mesh panels having reinforced tensioned upper and lower edges, the reinforced tensioned upper edge being suspended and maintained in position from above by tensioned cables extending diagonally upward and outward from the mesh panels at the confines of the outfield toward respective support posts outside the confines of the outfield, forming an elastically supported arced mesh and cable system, and said mesh panels being attached at the reinforced tensioned lower edge to the plurality of support posts sufficiently close to the ground surface to prevent a baseball or softball from rolling between the lower edge and the ground surface, each mesh panel defining a respective plane which is angularly displaced from a respective defined plane of an adjacent mesh panel by an outward component of the tension supplied by the tensioned cables from the plurality of fixed support posts, and said mesh panels being effective for confining within said outfield a player of said game who runs into said fence, causing a nondestructive deflection of the mesh and cable system, substantially without movement of the fixed support posts, thereby minimizing any injury to said player from impacting said fence.

2. A fence as in claim 1, wherein said mesh panels are further effective to confine within said outfield said baseball or softball moving along the ground surface.

3. A fence as in claim 1, wherein any one of said mesh panels that said player impacts is effective for repelling said player back into said outfield.

4. A fence as in claim 1, wherein each of said support posts is removably anchored in concrete to provide a concrete anchor.

5. A fence as in claim 4, wherein said fence is configured to be removed from the outfield, and each of said support post's concrete anchor has an upper surface disposed an effective distance below a level of the ground surface such that the support post's concrete anchor does not interfere with play of a sports game when said fence is removed from the outfield.

6. A fence as in claim 1, wherein said support post has a top portion which extends above a top edge of said mesh panel, and which is configured to suspend the mesh panel, the portion being bent from a lower portion of the support post toward the mesh panel such that the lower portion of the support post is displaced further from the mesh panel than the top portion, which ensures that a player running into said fence makes contact with said mesh panel which is displaced inside of the outfield with respect to the support posts.

7. A fence as in claim 1, wherein said support posts are rigid, whereby a player running into said fence makes contact with said mesh panels substantially without making contact with said support posts.

8. A fence as in claim 7, wherein said cable system comprises an eyebolt, a pair of snap links, and a diagonal connector cable which is surrounded by a diagonal connector cable sleeve, wherein a bottom end of the diagonal connector cable is connected to a first of the pair of snap links, which in turn is connected to support a top edge of a respective mesh panel, and an upper end of the diagonal connector cable is connected to a second of the pair of snap links, which is in turn connected to the eye bolt mounted on a respective support post in fixed position.

9. A method of preventing injury to a player who, in a game played with bat and ball, runs into an outfield fence of a field where said game is played, said method comprising the steps of:

bounding said field by a fence according to claim 1; and said mesh panels being formed of an elasticity effective material for deflecting under the impact of a player and thereafter restoring to its full integrity after such impact, to thereby confine a player said outfield who runs into said outfield boundary.

10. The method of claim 9, wherein the outfield is part of a multipurpose field, further comprising removing the fence from the multipurpose field to permit the field to be used for a different game, wherein the support posts have predetermined mounts in the ground, and wherein the predetermined mounts are provided exclusively below ground level and substantially do not interfere with the different game.

11. A fence as in claim 1, wherein said support posts are fixed in the ground surface.

12. A sports field fence for confining a softball or baseball sports field having an outfield, comprising:

a plurality of support posts fixed in position, disposed in an arc outside of the outfield, supported from beneath a ground surface and being inwardly angled at an upper portion;

a continuous series of flexible, resilient mesh panels defining an arced outer edge of the outfield within and offset from the arc formed by the plurality of support posts, the resilient mesh panels being elastically suspended inside of the arc formed by the plurality of support posts by tensioning cables, a cable tensioned lower edge of the resilient mesh panels being held in fixed position with respect to the ground surface by a downward tension to thereby prevent a ball from rolling between the lower edge and the ground surface, and a cable tensioned upper reinforced edge being elastically suspended above the ground surface at spaced positions from the plurality of support posts by cables which extend diagonally outward and upward from the resilient mesh panels to the inwardly angled upper portion of respective ones of the plurality of support posts, each resilient mesh panel defining a respective plane, wherein a respective defined plane formed by a respective resilient mesh panel is angularly displaced from a respective defined plane of an adjacent mesh panel by a divergent outward component of the tension supplied by the tensioned cables from the plurality of support posts, forming a compliant mesh and cable tensioned system effective for constraining a sports player who runs into a respective mesh panel within the sports field, to prevent injury from impact against the support posts, via a nondestructive deflection of the mesh and cable system.

13. The sports field fence according to claim 12, wherein each mesh panel is attached to a respective support post from above by at least a cable, an eyebolt, and a snap link.

14. The sports field fence according to claim 12, wherein the mesh panels form a deflectable elastic barrier which absorbs impact from a sports player and returns to its original configuration after impact.

15. The sports field fence according to claim 12, further comprising a pair of foul posts defining a lateral edge of the outfield.

16. The sports field fence according to claim 15, wherein the mesh panels are effective for repelling a player back into the outfield.

17. The sports field fence according to claim 15, wherein each of the support posts is anchored in the ground surface, wherein the support posts are removable from a respective anchor, and a top surface of the respective anchor is below the ground surface.

18. The sports field fence according to claim 15, wherein the mesh panels are configured to form a continuous arc between the pair of foul poles.

19. A sports field fence for confining a sports field, comprising:

a plurality of support posts each having a fixed position in a ground surface and having an upward and inward extending portion with respect to the sports field, the plurality of support posts being respectively disposed in an arc;

a series of flexible, resilient mesh panels having upper and lower cables at each of respective upper and lower edges, wherein adjacent mesh panels transmit forces through the respective upper and lower cables, the upper cables being periodically elastically supported by diagonal cables extending upward and divergently outward toward the upward and inward extending portions of the plurality of support posts disposed in the arc, such that the mesh panels are maintained in a deflectable position spaced inside of and offset from the arc defined by the plurality of support posts so as to assume a configuration corresponding to the arc;

wherein the series of flexible, resilient mesh panels are provided substantially without interruption along the length of the fence;

wherein the lower cables are held sufficiently close to the ground surface by respective ground links to prevent a sports ball from rolling under the lower edge; and wherein the series of mesh panels supported by the upper cables, lower cables, diagonal cables and ground links are configured to constrain a sports player within the sports field and are elastically deflectable in response to an impact of the sports player to prevent injury from impact against the support posts.

20. The sports field fence according to claim 19, further comprising an eye bolt and a snap link for connecting each diagonal cable to the upper cable.

* * * * *